US010665198B2

(12) United States Patent
Lee

(10) Patent No.: US 10,665,198 B2
(45) Date of Patent: May 26, 2020

(54) DISPLAY APPARATUS

(71) Applicant: Samsung Display Co., Ltd., Yongin-Si, Gyeonggi-Do (KR)

(72) Inventor: Kyung-hun Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/939,552

(22) Filed: Mar. 29, 2018

(65) Prior Publication Data

US 2019/0088228 A1 Mar. 21, 2019

(30) Foreign Application Priority Data

Sep. 15, 2017 (KR) ..... 10-2017-0118869

(51) Int. Cl.

*G09G 3/30* (2006.01)
*G09G 3/36* (2006.01)
*G09G 3/34* (2006.01)

(52) U.S. Cl.

CPC ..... *G09G 3/3688* (2013.01); *G09G 3/3406* (2013.01); *G09G 3/3607* (2013.01); *G09G 3/3677* (2013.01); *G09G 3/3696* (2013.01); *G09G 2320/041* (2013.01); *G09G 2320/064* (2013.01); *G09G 2320/0653* (2013.01)

(58) Field of Classification Search

None

See application file for complete search history.

(56) References Cited

U.S. PATENT DOCUMENTS

| | | | | |
|---|---|---|---|---|
| 7,911,498 | B2 | 3/2011 | Shen | |
| 9,076,406 | B2 | 7/2015 | Seo et al. | |
| 2014/0168186 | A1* | 6/2014 | Kang | G09G 3/3648 345/212 |
| 2016/0189654 | A1 | 6/2016 | Kim et al. | |

FOREIGN PATENT DOCUMENTS

| | | | |
|---|---|---|---|
| KR | 1020080039719 | A | 5/2008 |
| KR | 101228131 | B1 | 2/2013 |
| KR | 101237201 | B1 | 2/2013 |
| KR | 1020140011577 | A | 1/2014 |
| KR | 1020140076984 | A | 6/2014 |
| KR | 1020150033168 | A | 4/2015 |
| KR | 1020160078783 | A | 7/2016 |
| KR | 101745418 | B1 | 6/2017 |

* cited by examiner

*Primary Examiner* — Joseph R Haley
(74) *Attorney, Agent, or Firm* — Cantor Colburn LLP

(57) ABSTRACT

A display apparatus includes a display panel including a plurality of pixels, a gate driver generating a plurality of gate signals using a gate-on voltage and a gate-off voltage and providing the gate signals to the pixels, a data driver providing data voltages to the pixels, a timing controller controlling an operation timing of the gate driver and the data driver, a voltage generator providing the gate-on voltage and the gate-off voltage to the gate driver, and a timer measuring an operation time and providing the measured operation time to the timing controller. The timing controller controls the voltage generator such that a level of the gate-on voltage is controlled depending on the operation time and the level of the gate-on voltage is controlled depending on a magnitude of the gate-on voltage in a different way from a way to control depending on the operation time and the temperature.

20 Claims, 13 Drawing Sheets

DISPLAY APPARATUS

This application claims priority to Korean Patent Application No. 10-2017-0118869, filed on Sep. 15, 2017, and all the benefits accruing therefrom under 35 U.S.C. § 119, the content of which in its entirety is herein incorporated by reference.

BACKGROUND

1. Field of Disclosure

The invention relates to a display apparatus. More particularly, the invention relates to a display apparatus capable of improving a display quality thereof.

2. Description of the Related Art

In general, a display apparatus includes a display panel including pixels to display an image, a gate driver applying gate signals to the pixels, a data driver applying data voltages to the pixels, and a timing controller controlling an operation of the gate driver and the data driver. The pixels receive the data voltages in response to the gate signals and display the image using the data voltages In general, the pixels include transistors turned on in response to the gate signals and pixel electrodes connected to the transistors. The turned-on transistors receive the data voltages and apply the data voltages to the pixel electrodes. Characteristics of the transistors are deteriorated due to various factors, such as an operation time, a temperature, a voltage, a brightness (e.g., an intensity of light), etc.

SUMMARY

The invention provides a display apparatus capable of improving a display quality thereof.

According to an exemplary embodiment of the inventive concept, a display apparatus includes a display panel which includes a plurality of pixels, a gate driver which generates a plurality of gate signals using a gate-on voltage and a gate-off voltage having a level less than the gate-on voltage and provides the gate signals to the pixels, a data driver which generates a plurality of data voltages corresponding to image data and provides the data voltages to the pixels, a timing controller which controls an operation timing of the gate driver and the data driver, a voltage generator which generates the gate-on voltage and the gate-off voltage and provides the gate-on voltage and the gate-off voltage to the gate driver, and a timer which measures an operation time and provides the measured operation time to the timing controller. The timing controller controls the voltage generator such that a level of the gate-on voltage is controlled depending on the operation time and the level of the gate-on voltage is controlled depending on a magnitude of the gate-on voltage in a different way from a way to control depending on the operation time and the temperature.

According to an exemplary embodiment of the inventive concept, a display apparatus includes a display panel which includes a plurality of pixels connected to a plurality of gate lines and a plurality of data lines, a gate driver which generates a plurality of gate signals using a gate-on voltage and a gate-off voltage having a level less than the gate-on voltage and provides the gate signals to the pixels through the gate lines, a data driver which provides a plurality of data voltages to the pixels through the data lines, a timing controller which controls an operation timing of the gate driver and the data driver, a voltage generator which generates the gate-on voltage and the gate-off voltage and provides the gate-on voltage and the gate-off voltage to the gate driver, a timer which measures an operation time and provides the measured operation time to the timing controller, and a temperature measuring unit which measures an ambient temperature of the display panel and provides the measured ambient temperature to the timing controller. The timing controller controls the voltage generator such that a level of the gate-on voltage is controlled depending on the operation time and the temperature and the level of the gate-on voltage is controlled depending on colors of the pixels in a different way from a way to control depending on the operation time and the temperature.

According to the above, the display apparatus controls the gate-on voltage, the gate-off voltage, an image data value, and a common voltage depending on an operation time, the temperature, the magnitude of gate-on voltage, and the brightness, and thus a charging rate of the pixels may be compensated. As a result, the display apparatus may effectively prevent the display quality from deteriorating, and thus the display quality may be improved.

BRIEF DESCRIPTION OF THE DRAWINGS

The above and other advantages of the invention will become readily apparent by reference to the following detailed description when considered in conjunction with the accompanying drawings wherein.

DETAILED DESCRIPTION

Figure 1:
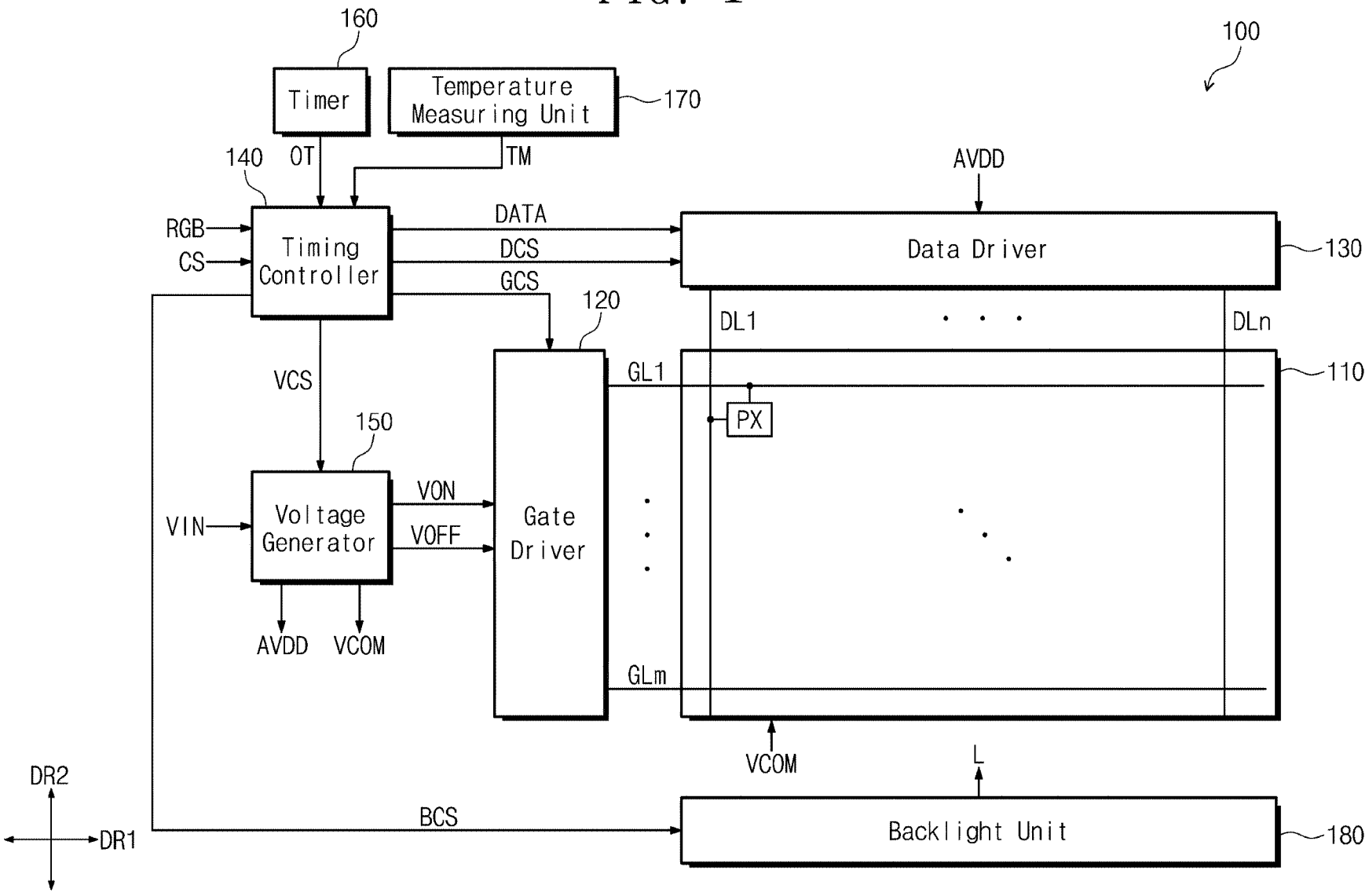
FIG. 1 is a block diagram showing an exemplary embodiment of a display apparatus according to the invention.

Features of the inventive concept and methods of accomplishing the same may be understood more readily by reference to the following detailed description of preferred exemplary embodiments and the accompanying drawings. The inventive concept may, however, be embodied in many different forms and should not be construed as being limited to the exemplary embodiments set forth herein. Rather, these exemplary embodiments are provided so that this disclosure will be through and complete and will fully convey the inventive concept to those skilled in the art, and the inventive concept will only be defined by the appended claims. Like reference numerals denote like elements throughout the specification.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items.

Spatially relative terms, such as "beneath", "below", "less", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Exemplary embodiments are described herein with reference to plan views and cross-sectional views that are schematic illustrations of idealized exemplary embodiments. As such, variations from the shapes of the illustrations as a result, for example, of manufacturing techniques and/or tolerances, are to be expected. Thus, exemplary embodiments should not be construed as limited to particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the exemplary embodiments.

Hereinafter, the invention will be explained in detail with reference to the accompanying drawings.

Figure 2:
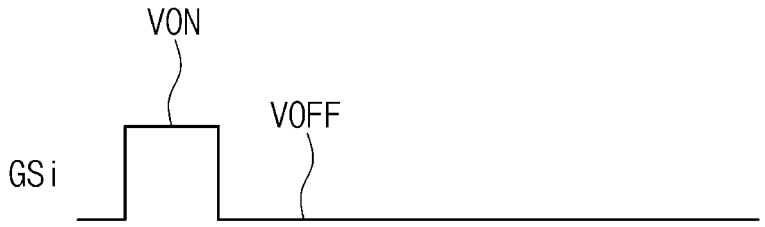
FIG. 2 is a view showing an exemplary embodiment of one gate signal generated by a gate driver shown in FIG. 1.

FIG. 1 is a block diagram showing an exemplary embodiment of a display apparatus 100 according to the invention. FIG. 2 is a view showing an exemplary embodiment of one gate signal generated by a gate driver shown in FIG. 1.

Referring to FIGS. 1 and 2, the display apparatus 100 includes a display panel 110, a gate driver 120, a data driver 130, a timing controller 140, a voltage generator 150, a timer 160, a temperature measuring unit 170, and a backlight unit 180.

The display panel 110 may be a liquid crystal display panel including a liquid crystal layer, but the display panel 110 according to the invention should not be limited to the liquid crystal display panel. That is, as the display panel 110, various panels, such as an electrophoretic display panel including an electrophoretic layer, an electrowetting display panel including an electrowetting layer, an organic light emitting display panel including an organic light emitting layer, etc., may be used in another exemplary embodiment.

The display panel 110 includes a plurality of gate lines GL1 to GLm, a plurality of data lines DL1 to DLn, and a plurality of pixels PX. For the convenience of explanation, FIG. 1 shows one pixel, however, plural pixels PX may be arranged in the display panel 110 in an exemplary embodiment. Each of "m" and "n" is a natural number.

The gate lines GL1 to GLm and the data lines DL1 to DLn are insulated from each other while crossing each other. The gate lines GL1 to GLm extend in a first direction DR1 and are connected to the gate driver 120. The data lines DL1 to DLn extend in a second direction DR2 and are connected to the data driver 130.

The pixels PX are arranged in areas defined by the gate lines GL1 to GLm and the data lines DL1 to DLn crossing the gate lines GL1 to GLm. The pixels PX are arranged in a matrix form and connected to the gate lines GL1 to GLm and the data lines DL1 to DLn. Each of the pixels PX may display one of primary colors. The primary colors may include a red color, a green color, and a blue color, but the kinds of the primary colors according to the invention should not be limited thereto or thereby. That is, the primary colors may further include a white color, a yellow color, a cyan color, a magenta color, etc.

The timing controller 140 receives a plurality of image signals RGB to display a corresponding image and control signals CS to control an operation of the gate driver 120 and the data driver 130 from an external source (e.g., a system board). The image signals RGB may include red, green, and blue image signals.

The timing controller 140 converts a data format of the image signals RGB to a data format appropriate to an interface between the data driver 130 and the timing controller 140. The timing controller 140 provides the image signals RGB whose data format is converted to the data driver 130 as image data.

The timing controller 140 generates a gate control signal GCS and a data control signal DCS based on the control signals CS. The gate control signal GCS is provided to the gate driver 120 as a control signal to control an operation timing of the gate driver 120. The data control signal DCS is provided to the data driver 130 as a control signal to control an operation timing of the data driver 130.

The timing controller 140 analyzes the image signals RGB and calculates a brightness value needed to display the image. The timing controller 140 generates a backlight control signal BCS based on the calculated brightness value to control a brightness of the backlight unit 180. The backlight control signal BCS is provided to the backlight unit 180, and the backlight unit 180 generates a light L having the brightness corresponding to the calculated brightness value in response to the backlight control signal BCS and provides the light L to the display panel 110.

The backlight control signal BCS is a control signal to drive the backlight unit 180 in a dimming method. The dimming method is a technique, which controls a light amount (or brightness) of the backlight unit 180 in consideration of the brightness of the image, to reduce a power consumption. Although not shown in figures, the backlight control signal BCS may include a pulse width modulation ("PWM") signal. A duty ratio of the PWM signal used to drive the backlight unit 180 may be controlled depending on the brightness of the image.

The voltage generator 150 receives an input voltage VIN from the outside thereof and generates a gate-on voltage VON, a gate-off voltage VOFF, an analog voltage AVDD, and a common voltage VCOM based on the input voltage VIN. The gate-on voltage VON and the gate-off voltage VOFF are applied to the gate driver 120, the analog voltage AVDD is applied to the data driver 130, and the common voltage VCOM is applied to the display panel 110.

The gate driver 120 receives the gate control signal GCS from the timing controller 140 and generates a plurality of gate signals in response to the gate control signal GCS. The gate driver 120 may generate the gate signals based on the gate-on voltage VON and the gate-off voltage VOFF.

As shown in FIG. 2, a high level of each of the gate signals GSi is determined as the gate-on voltage VON, and a low level of each of the gate signals GSi is determined as the gate-off voltage VOFF. The gate signals may be sequentially output and applied to the pixels PX arranged in the unit of row through the gate lines GL1 to GLm.

The data driver 130 receives the image data DATA and the data control signal DCS from the timing controller 140 and generates data voltages in analog form corresponding to the image data DATA in response to the data control signal DCS. The data voltages may be generated using the analog voltage AVDD generated on the voltage generator 150. The data voltages are provided to the pixels PX through the data lines DL1 to DLn.

The timer 160 may measure an operation time of the display apparatus 100. The timer 160 may be operated when the display apparatus 100 starts to operate. The timer 160 may measure the operation time of the display apparatus 100 by counting clocks generated by a clock generator (not shown) installed therein.

The operation time of the display apparatus 100 substantially corresponds to an operation time of the pixels PX, and the operation time measured by the timer 160 may be estimated as an operation time of the transistors of the pixels PX. Information about the operation time measured by the timer 160 is provided to the timing controller 140 as a first signal OT.

The temperature measuring unit 170 measures an ambient temperature of the display panel 110 and provides information about the measured temperature to the timing controller 140 as a second signal TM. Although not shown in figures, the temperature measuring unit 170 may include a temperature sensor or a thermistor whose resistance is dependent on a temperature to measure the ambient temperature.

In an exemplary embodiment, for an example, the timer 160 and the temperature measuring unit 170 are provided separately from the timing controller 140, but the disposition of the timer 160 and the temperature measuring unit 170 according to the invention should not be limited thereto or thereby. That is, the timer 160 and the temperature measuring unit 170 may be provided inside the timing controller 140 in another exemplary embodiment.

The timing controller 140 receives the first signal OT and the second signal TM and checks the operation time and the temperature based on the first signal OT and the second signal TM. The timing controller 140 may apply a voltage control signal VCS to the voltage generator 150 to control the gate-on voltage VON, the gate-off voltage VOFF, or the common voltage VCOM depending on the operation time and the temperature. In addition, the timing controller 140 may apply the voltage control signal VCS to the voltage generator 150 to control the gate-on voltage VON differently according to a magnitude of the gate-on voltage VON at a predetermined time and to control the gate-off voltage VOFF differently according to a magnitude of the gate-off voltage VOFF at a predetermined time.

Hereinafter, magnitude of a voltage is referred to an absolute value of a difference between a reference level and a level of the voltage. The gate-on voltage VON has a positive voltage level greater than the reference level, and the gate-off voltage VOFF has a negative voltage level less than the reference level.

The timing controller 140 may apply the voltage control signal VCS to the voltage generator 150 to control the gate-on voltage VON according to the brightness value calculated based on the image signals RGB. In addition, the timing controller 140 may control and output values of the image data DATA according to the brightness value calculated based on the image signals RGB. The voltage generator 150 may control and output the gate-on voltage VON, the gate-off voltage VOFF, or the common voltage VCOM in response to the voltage control signal VCS. This operation will be described in detail later.

The pixels PX receive the data voltages through the data lines DL1 to DLn in response to the gate signals provided through the gate lines GL1 to GLm. The pixels PX driven by the data voltages display the image by controlling a transmittance of the light received from the backlight unit 180, thereby displaying grayscales corresponding to the data voltages.

Figure 3:
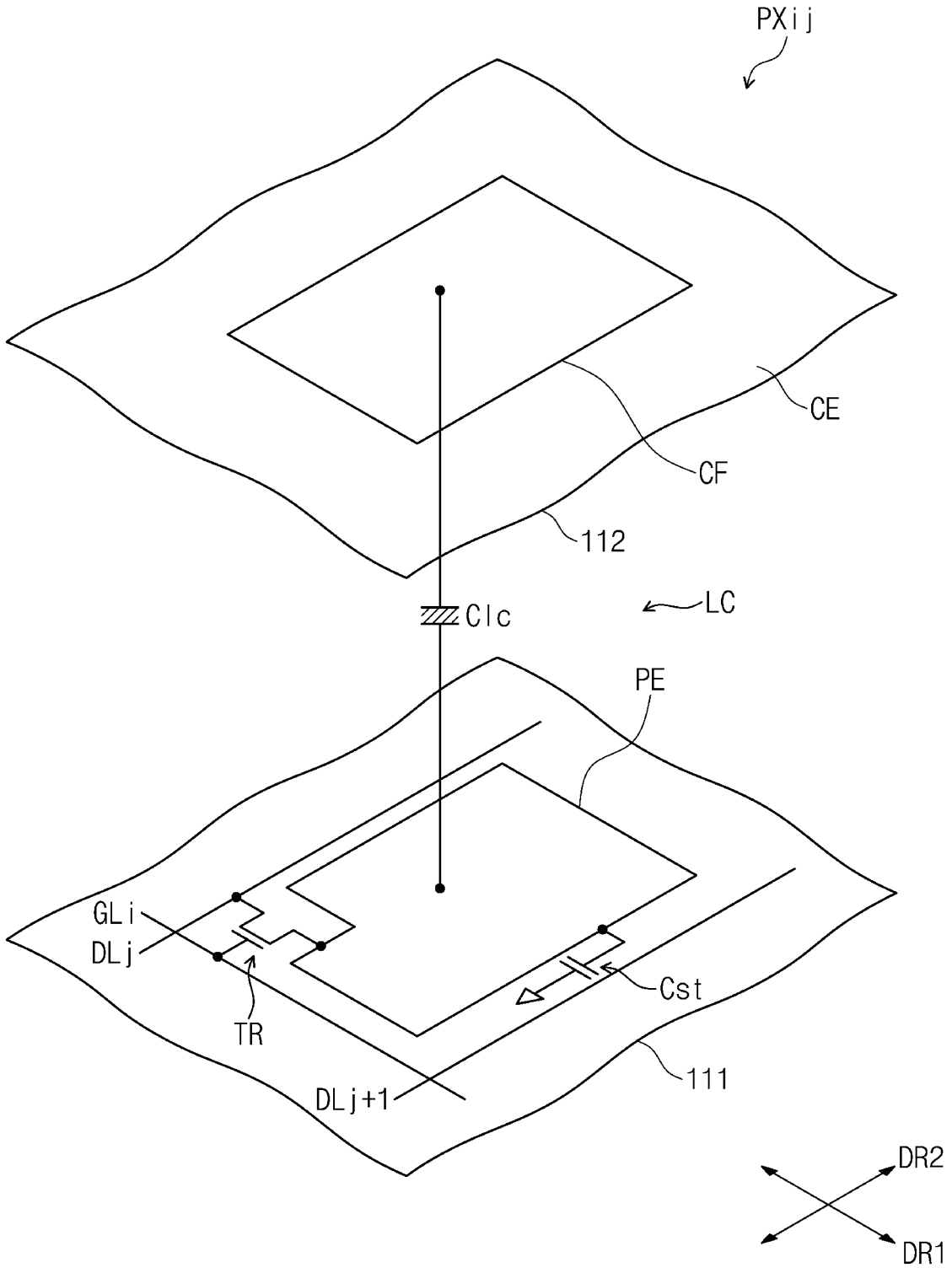
FIG. 3 is a perspective view showing an exemplary embodiment of a configuration of a pixel shown in FIG. 1.

FIG. 3 is a perspective view showing an exemplary embodiment of a configuration of a pixel shown in FIG. 1.

For the convenience of explanation, FIG. 3 shows the pixel PXij connected to a gate line GLi and a data line DLj, but other pixels PX of the display panel 110 may have the same structure and function as those of the pixel PXij shown in FIG. 3.

Referring to FIG. 3, the pixel PXij includes a transistor TR connected to the gate line GLi and the data line DLj, a liquid crystal capacitor Clc connected to the transistor TR, and a storage capacitor Cst connected to the liquid crystal capacitor Clc in parallel. The storage capacitor Cst may be omitted. Each of "i" and "j" is a natural number.

The transistor TR may be disposed on a first substrate 111. The transistor TR includes a gate electrode (not shown) connected to the gate line GLi, a source electrode (not shown) connected to the data line DLj, and a drain electrode (not shown) connected to the liquid crystal capacitor Clc and the storage capacitor Cst.

The liquid crystal capacitor Clc includes a pixel electrode PE disposed on the first substrate 111, a common electrode CE disposed on a second substrate 112, and a liquid crystal layer LC interposed between the pixel electrode PE and the common electrode CE. The liquid crystal layer LC serves as a dielectric substance. The pixel electrode PE is connected to the drain electrode of the transistor TR.

In FIG. 3, the pixel electrode PE has a non-slit structure, but the structure of the pixel electrode PE according to the invention should not be limited thereto or thereby. That is, the pixel electrode PE may have a slit structure defined by a trunk portion with a cross shape and a plurality of branch portions extending from the trunk portion in a radial direction in another exemplary embodiment. The common electrode CE may be disposed over the second substrate 112, but the disposition of the common electrode CE according to the invention should not be limited thereto or thereby. That is, the common electrode CE may be disposed on the first substrate 111 in another exemplary embodiment. In this case, at least one of the pixel electrode PE and the common electrode CE may have slits.

The storage capacitor Cst may include the pixel electrode PE, a storage electrode (not shown) branched from a storage line (not shown), and an insulating layer disposed between the pixel electrode PE and the storage electrode. The storage line may be disposed on the first substrate 111 and substantially simultaneously formed with the gate lines GL1 to GLm on the same layer. The storage electrode may partially overlap with the pixel electrode PE.

The pixel PXij may further include a color filter CF displaying one of red, green, and blue colors. In an exemplary embodiment, for an example, the color filter CF may be disposed on the second substrate 112 as shown in FIG. 3. However, the color filter CF may be disposed on the first substrate 111 according to other exemplary embodiments.

The transistor TR is turned on in response to the gate signal provided thereto through the gate line GLi. The data voltage provided through the data line DLj is applied to the pixel electrode PE of the liquid crystal capacitor Clc through the turned-on transistor TR. The common electrode CE is applied with the common voltage VCOM.

An electric field is generated between the pixel electrode PE and the common electrode CE due to a difference in voltage level between the data voltage and the common voltage VCOM. Liquid crystal molecules of the liquid crystal layer LC are driven by the electric field generated between the pixel electrode PE and the common electrode CE. A light transmittance of the liquid crystal layer LC is controlled by the liquid crystal molecules driven by the electric field, and thus a desired image is displayed.

The storage line is applied with a storage voltage having a constant voltage level, but the storage line may be applied with the common voltage VCOM according to other exemplary embodiments. The storage capacitor Cst compensates for a charge rate of the liquid crystal capacitor Clc.

Figure 4:
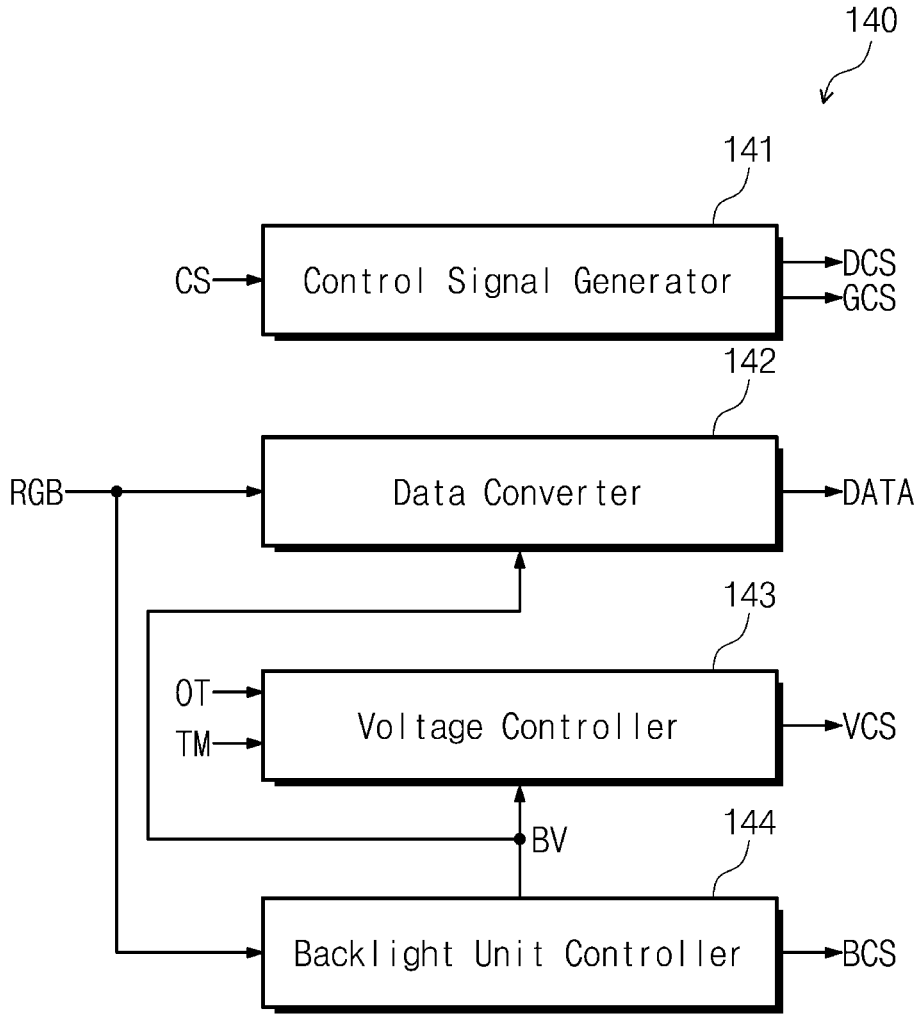
FIG. 4 is a block diagram showing an exemplary embodiment of a timing controller shown in FIG. 1.
Figure 5:
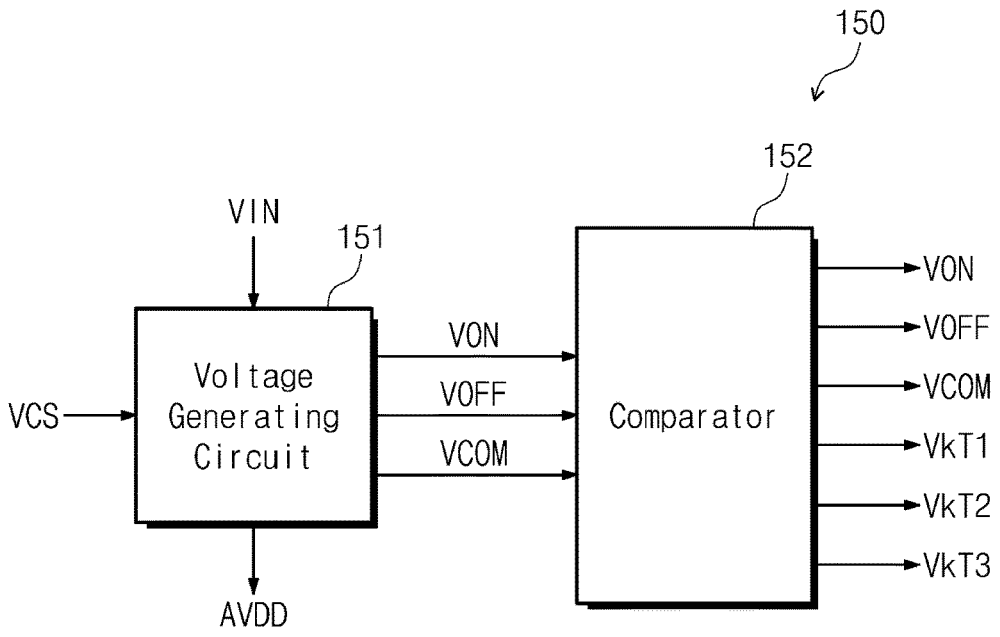
FIG. 5 is a block diagram showing an exemplary embodiment of a voltage generator shown in FIG. 1.

FIG. 4 is a block diagram showing an exemplary embodiment of the timing controller 140 shown in FIG. 1, and FIG. 5 is a block diagram showing an exemplary embodiment of the voltage generator 150 shown in FIG. 1.

Referring to FIG. 4, the timing controller 140 includes a control signal generator 141, a data converter 142, a voltage controller 143, and a backlight unit controller 144. The control signal generator 141 receives the control signal CS and generates the gate control signal GCS and the data control signal DCS in response to the control signal CS to output the gate control signal GCS and the data control signal DCS. The data converter 142 receives the image signals RGB and converts the image signals RGB to the image data DATA to output the image data DATA.

The backlight unit controller 144 receives the image signals RGB and analyzes the image signals RGB to calculate the brightness value BV that is needed to display the image. The backlight unit controller 144 generates the backlight control signal BCS based on the calculated brightness value BV, which is used to control the brightness of light provided from the backlight unit 180, and provides the backlight control signal BCS to the backlight unit 180. The backlight unit controller 144 may provide the brightness value BV to the data converter 142 and the voltage controller 143.

The voltage controller 143 receives the first signal OT, the second signal TM, and the brightness value BV and generates the voltage control signal VCS based on the first signal OT, the second signal TM, and the brightness value BV. The voltage controller 143 provides the voltage control signal VCS to the voltage generator 150.

The voltage controller 143 may control the voltage generator 150 to control the level of the gate-on voltage VON, the gate-off voltage VOFF, or the common voltage VCOM by the voltage control signal VCS. In addition, the voltage controller 143 may control the voltage generator 150 to control the gate-on voltage VON differently according to the magnitude of the gate-on voltage VON at a predetermined time and to control the gate-off voltage VOFF differently according to the magnitude of the gate-off voltage VOFF at a predetermined time.

For instance, the voltage controller 143 may control the voltage generator 150 such that the level of the gate-on voltage VON increases as the operation time increases and such that the level of the gate-on voltage VON increases as the temperature increases. The voltage controller 143 may control the voltage generator 150 such that a level increasing rate of the gate-on voltage VON increases as the level of an initial gate-on voltage VON increases.

The voltage controller 143 may control the voltage generator 150 such that the level of the gate-off voltage VOFF decreases as the operation time increases and such that the level of the gate-off voltage VOFF decreases as the temperature increases. The voltage controller 143 may control the voltage generator 150 such that an absolute value of a level decreasing rate of the gate-off voltage VOFF increases as the level of an initial gate-off voltage VOFF decreases.

The voltage controller 143 may control the voltage generator 150 such that the level of the common voltage VCOM increases as the operation time increases and the temperature increases. The voltage controller 143 may control the voltage generator 150 such that the level of the gate-on voltage VON increases as the brightness value increases.

The data converter 142 controls values of the image data DATA on the basis of the brightness value BV provided from the backlight unit controller 144. For instance, the data converter 142 may control the values of the image data DATA such that the values (e.g., grayscale values) of the image data DATA increase as the brightness increases.

In the case that the values of the image data DATA increase, the level of the data voltages generated using the image data DATA may also increase. Accordingly, the data converter 142 may control the data driver 130 such that the level of the data voltages generated by the data driver 130 increases as the brightness increases.

Referring to FIG. 5, the voltage generator 150 includes a voltage generating circuit 151 and a comparator 152. The voltage generating circuit 151 receives the input voltage VIN and generates the gate-on voltage VON, the gate-off voltage VOFF, the common voltage VCOM, and the analog voltage AVDD in response to the voltage control signal VCS provided from the voltage controller 143.

The gate-on voltage VON, the gate-off voltage VOFF, and the common voltage VCOM are provided to the comparator 152, and the analog voltage AVDD is provided to the data driver 130. The comparator 152 compares values of the gate-on voltage VON, the gate-off voltage VOFF, and the common voltage VCOM with values of first, second, and third threshold voltages VkT1, VkT2, and VkT3, respectively.

In a case that the gate-on voltage VON is less than the first threshold voltage VkT1, the comparator 152 outputs the gate-on voltage VON, and in a case that the gate-on voltage VON is equal to the first threshold voltage VkT1, the comparator 152 outputs the first threshold voltage VkT1 as the gate-on voltage VON.

In a case that the gate-off voltage VOFF is less than the second threshold voltage VkT2, the comparator 152 outputs the gate-off voltage VOFF, and in a case that the gate-off voltage VOFF is equal to the second threshold voltage VkT2, the comparator 152 outputs the second threshold voltage VkT2 as the gate-off voltage VOFF.

In a case that the common voltage VCOM is less than the third threshold voltage VkT3, the comparator 152 outputs the common voltage VCOM, and in a case that the common voltage VCOM is equal to the third threshold voltage VkT3, the comparator 152 outputs the third threshold voltage VkT3 as the common voltage VCOM.

Figure 6:
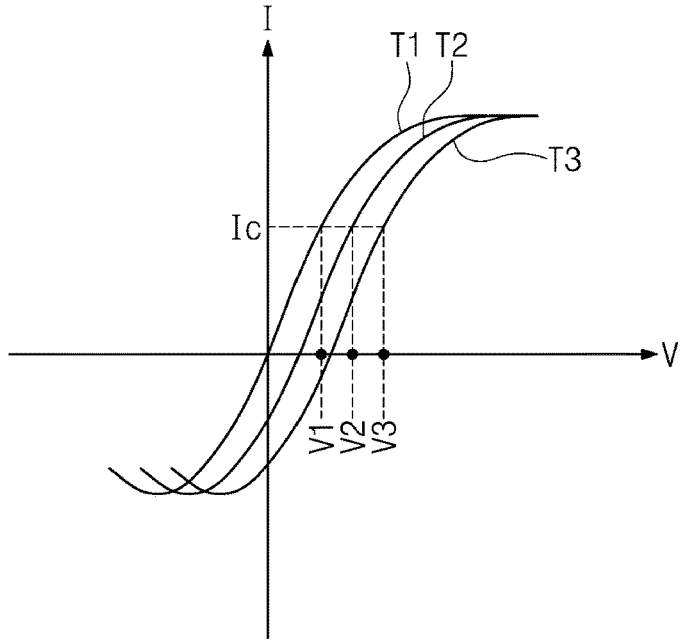
FIG. 6 is a view showing a current (I)-voltage (V) characteristic of a transistor depending on an operation time, a temperature, and magnitudes of gate-on and -off voltages.

FIG. 6 is a view showing a current (I)-voltage (V) characteristic of a transistor depending on an operation time, a temperature, and magnitudes of gate-on and -off voltages.

Referring to FIG. 6, the I-V characteristic of the transistor TR in an initial state represented as a first graph T1 may be changed in a deterioration state to those represented as second and third graphs T2 and T3 as the operation time increases, the temperature increases, the gate-on voltage VON increases, and the gate-off voltage VOFF decreases.

Since the I-V characteristic graph of the transistor TR is commonly shifted to a right direction as the operation time increases, the temperature increases, the level of the gate-on voltage VON increases, and the level of the gate-off voltage VOFF decreases, the I-V characteristic graphs representing the shift are illustrated in one figure (e.g., FIG. 6) for a common purpose, without showing the I-V characteristic graphs with respect to the operation time, the temperature, the gate-on voltage VON, and the gate-off voltage VOFF, respectively.

In the case that the transistor TR is deteriorated, an amount of a current flowing through the transistor TR decreases. As a result, the pixels PX may not be normally charged, and the image displayed by the pixels PX may not be normally displayed. Accordingly, in the case that the transistor TR is deteriorated, a voltage value required to provide a predetermined current Ic to the pixel electrode PE through the transistor TR is a second voltage V2 or a third voltage V3, which is greater than a first voltage V1.

In an exemplary embodiment of the invention, the level of the gate-on voltage VON and the level of the gate-off voltage VOFF provided to the gate driver 120 may be controlled in various ways depending on the operation time, the temperature, the magnitude of the gate-on voltage VON at a predetermined time, and the magnitude of the gate-off voltage VOFF at a predetermined time to compensate the deterioration of the transistor TR. In addition, in an exemplary embodiment of the invention, the levels of the gate-on voltage VON and the data voltages provided to the gate driver 120 may be controlled depending on the brightness, and the level of the common voltage VCOM provided to the gate driver 120 may be controlled depending on the operation time and the temperature.

Hereinafter, the operation of controlling the gate-on voltage VON, the gate-off voltage VOFF, the data voltages, and the common voltage VCOM will be described in detail with reference to FIGS. 7 to 13.

Figure 7:
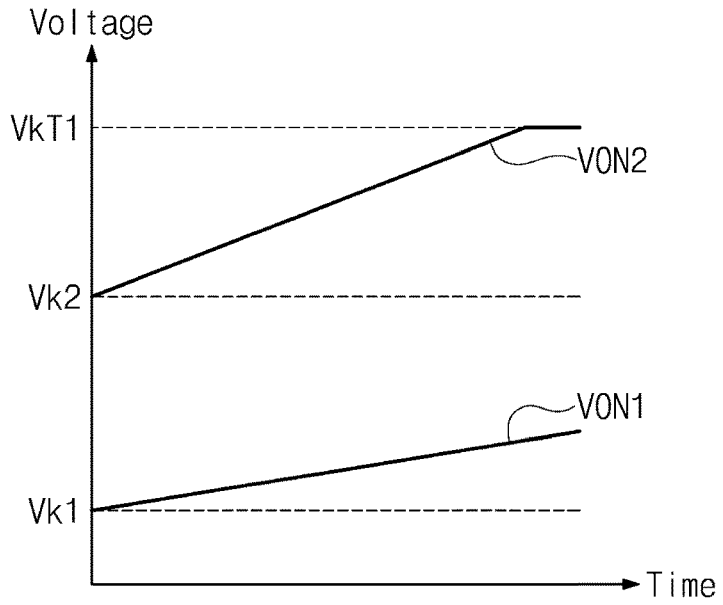
FIG. 7 is a view for explaining an exemplary embodiment of a compensation for the gate-on voltage depending on an operation time and magnitude of the gate-on voltage.

FIG. 7 is a view for explaining an exemplary embodiment of a compensation for the gate-on voltage depending on the operation time or magnitude of the gate-on voltage.

Referring to FIG. 7, an initial voltage level of the gate-on voltage VON (i.e., a voltage level when the operation time is zero) may be differently set depending on the display apparatus 100. For instance, the initial voltage level of the gate-on voltage VON may be set to a first initial voltage level Vk1 or a second initial voltage level Vk2 greater than the first initial voltage level Vk1.

The level of the gate-on voltage VON or the increasing rate of the gate-on voltage VON provided to the gate driver 120 may be differently controlled depending on the operation time or the magnitude of the gate-on voltage VON. For instance, since the transistors TR are more deteriorated as the operation time of the display apparatus 100 increases, the level of the gate-on voltage VON to be provided to the gate driver 120 may be controlled such that the level of the gate-on voltage VON increases as the operation time increases to compensate the deterioration. In addition, since the transistors TR are more deteriorated as the magnitude of the gate-on voltage VON increases, the level increasing rate of the gate-on voltage VON may be controlled such that the level increasing rate of the gate-on voltage VON increases as the level of the gate-on voltage VON increases to compensate the deterioration. In other words, the level increasing rate of the gate-on voltage VON may be controlled to be greater, when the level of the gate-on voltage VON is high, than the level increasing rate of the gate-on voltage VON when the level of the gate-on voltage VON is low at a predetermined time (initial time, current time, a combination thereof, etc.).

In detail, a level of a first gate-on voltage VON1 having the first initial voltage level Vk1 (i.e., a voltage level when the operation time is zero) may be controlled such that the level of the first gate-on voltage VON1 gradually increases to be greater than the first initial voltage level Vk1 as the operation time increases without being maintained at the first initial voltage level Vk1. A level of a second gate-on voltage VON2 having the second initial voltage level Vk2 (i.e., a voltage level when the operation time is zero) may be controlled such that the level of the second gate-on voltage VON2 gradually increases to be greater than the second initial voltage level Vk2 as the operation time increases without being maintained at the second initial voltage level Vk2.

Since the level of the second gate-on voltage VON2 is greater than the level of the first gate-on voltage VON1, the level of the second gate-on voltage VON2 or the level of the first gate-on voltage VON1 provided to the gate driver 120 may be controlled such that the level increasing rate of the second gate-on voltage VON2 is greater than the level increasing rate of the first gate-on voltage VON1.

The transistor TR is more deteriorated as the operation time increases, and the deterioration of the transistor TR reaches a saturation state. In the case that the deterioration of the transistor TR reaches the saturation state, the level of the gate-on voltage VON does not need to be high anymore. When the deterioration of the transistor TR is in the saturation state, the level of the gate-on voltage VON corresponding to the saturation state of the deterioration of the transistor TR may be set to the first threshold voltage VkT1 even though the operation time increases thereafter.

In the case that the level of the gate-on voltage VON reaches the first threshold voltage VkT1 due to the operation of the above-described comparator 152, the gate-on voltage VON provided to the gate driver 120 may be controlled to be maintained at the first threshold voltage VkT1. For instance, in the case that the level of the second gate-on voltage VON2 gradually increases to have the same value as the first threshold voltage VkT1, the second gate-on voltage VON2 is controlled to be maintained at the first threshold voltage VkT1 since the level of the second gate-on voltage VON2 reaches the first threshold voltage VkT1.

In the case that the level of the gate-on voltage VON increases in FIG. 2, a difference between the gate-on voltage VON and the gate-off voltage VOFF may also increase. In this case, the magnitude of the gate signal GSi increases. In the case that the magnitude of the gate signal GSi increases, the amount of the current flowing through the transistor TR, which is turned on in response to the gate signal GSi, may increase. Accordingly, the pixels PX are normally charged, and the display quality may be improved when the increased current compensates the deterioration mentioned above.

Even though FIG. 7 illustrates that the gate-on voltage VON increases substantially linearly as the operation time increases. However, the increasing pattern is not limited thereto. In another exemplary embodiment, the gate-on voltage VON increases nonlinearly as the operation time increases.

Figure 8:
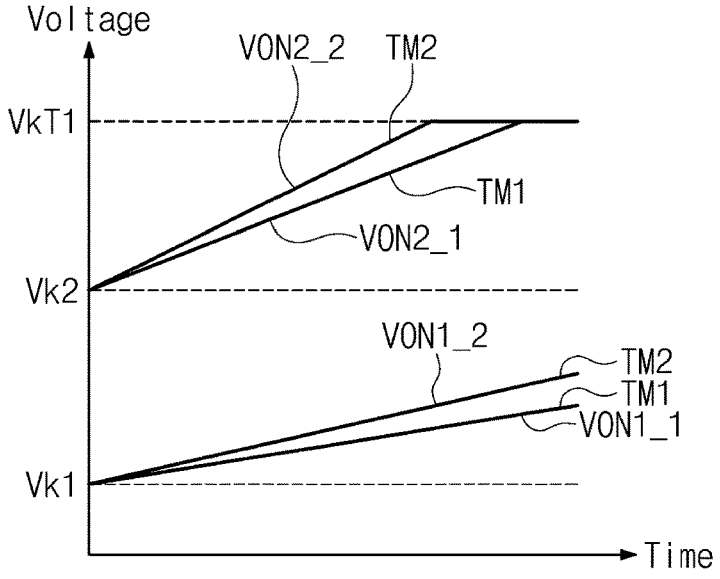
FIG. 8 is a view for explaining an exemplary embodiment of the compensation for the gate-on voltage depending on the operation time, the temperature and magnitude of the gate-on voltage.

FIG. 8 is a view for explaining an exemplary embodiment of the compensation for the gate-on voltage depending on the operation time, the temperature and magnitude of the gate-on voltage.

Referring to FIG. 8, the level increasing rate of the gate-on voltage VON may be differently controlled depending on the operation time, the temperature, and the magnitude of the gate-on voltage VON. The transistors TR are more deteriorated as the temperature of the display apparatus 100 increases. Accordingly, the level of the gate-on voltage VON may be controlled such that the level of the gate-on voltage VON provided to the gate driver 120 increases as the operation time increases and as the temperature increases. In addition, the level increasing rate of the gate-on voltage VON provided to the gate driver 120 may be controlled such that the level increasing rate of the gate-on voltage VON is determined depending on the magnitude of the gate-on voltage VON.

In detail, a level of a first sub-gate-on voltage VON1_1 having the first initial voltage level Vk1 may be controlled such that the level of the first sub-gate-on voltage VON1_1 provided to the gate driver 120 gradually increases to be greater than the first initial voltage level Vk1 as the operation time increases and the temperature increases to a first temperature TM1 without being maintained at the first initial voltage level Vk1.

A level of a second sub-gate-on voltage VON1_2 having the first initial voltage level Vk1 may be controlled such that the level of the second sub-gate-on voltage VON1_2 provided to the gate driver 120 gradually increases to be greater than the first initial voltage level Vk1 and to be greater than the level of the first sub-gate-on voltage VON1_1 as the operation time increases and the temperature increases to a second temperature TM2 greater than the first temperature TM1 without being maintained at the first initial voltage level Vk1.

A level of a third sub-gate-on voltage VON2_1 having the second initial voltage level Vk2 may be controlled such that the level of the third sub-gate-on voltage VON2_1 provided to the gate driver 120 gradually increases to be greater than the second initial voltage level Vk2 as the operation time increases and the temperature increases to the first temperature TM1 without being maintained at the second initial voltage level Vk2.

A level of a fourth sub-gate-on voltage VON2_2 having the second initial voltage level Vk2 may be controlled such that the level of the fourth sub-gate-on voltage VON2_2 provided to the gate driver 120 gradually increases to be greater than the second initial voltage level Vk2 and to be greater than the level of the third sub-gate-on voltage VON2_1 as the operation time increases and the temperature increases to the second temperature TM2 without being maintained at the second initial voltage level Vk2.

In addition, the levels of the third and fourth sub-gate-on voltages VON2_1 and VON2_2 may be controlled such that the level increasing rates of the third and fourth sub-gate-on voltages VON2_1 and VON2_2 provided to the gate driver 120 become greater than the level increasing rates of the first and second sub-gate-on voltages VON1_1 and VON1_2 provided to the gate driver 120, since the magnitude of the third and fourth sub-gate-on voltages VON2_1 and VON2_2 is greater than the magnitude of the first and second sub-gate-on voltages VON1_1 and VON1_2. In the case that levels of the third and fourth sub-gate-on voltages VON2_1 and VON2_2 gradually increase to have the same value as the first threshold voltage VkT1, the third and fourth sub-gate-on voltages VON2_1 and VON2_2 provided to the gate driver 120 are controlled to maintain at the first threshold voltage VkT1 even though the operation time increases thereafter.

Figure 9:
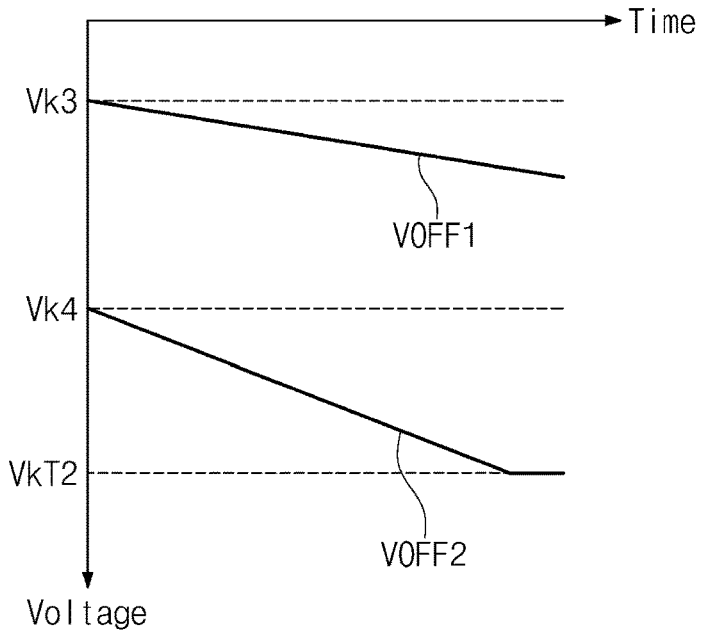
FIG. 9 is a view for explaining an exemplary embodiment of the compensation for the gate-off voltage depending on the operation time and magnitude of the gate-off voltage.

FIG. 9 is a view for explaining an exemplary embodiment of the compensation for the gate-off voltage depending on the operation time and the magnitude of the gate-on voltage.

Referring to FIG. 9, an initial voltage level of the gate-off voltage VOFF may be set to a third initial voltage level Vk3 (i.e., a voltage level when the operation time is zero) or a fourth initial voltage level Vk4 less than the third initial voltage level Vk3.

The level decreasing rate of the gate-off voltage VOFF may be differently controlled depending on the operation time and the magnitude of the gate-off voltage VOFF. For instance, the level of the gate-off voltage VOFF may be controlled such that the level of the gate-off voltage VOFF provided to the gate driver 120 decreases as the operation time increases. In addition, the transistors TR are more deteriorated as the level of the gate-off voltage VOFF decreases. Accordingly, the level of the gate-off voltage VOFF may be controlled such that the absolute value of level decreasing rate of the gate-off voltage VOFF increases as the level of the gate-off voltage VOFF decreases to compensate the deterioration. In other words, the absolute value of the level decreasing rate of the gate-off voltage VFF may be controlled to be greater, when the level of the gate-off voltage VOFF is relatively low, than the absolute value of the level decreasing rate of the gate-off voltage VFF when the level of the gate-off voltage VOFF is relatively high at a predetermined time (initial time, current time, a combination thereof, etc.).

In detail, a level of a first gate-off voltage VOFF1 having the third initial voltage level Vk3 may be controlled such that the level of the first gate-off voltage VOFF1 provided to the gate driver 120 gradually decreases to be less than the third initial voltage level Vk3 as the operation time increases without being maintained at the third initial voltage level Vk3. A level of a second gate-off voltage VOFF2 having the fourth initial voltage level Vk4 may be controlled such that the level of the second gate-off voltage VOFF2 provided to the gate driver 120 gradually decreases to be less than the fourth initial voltage level Vk4 as the operation time increases without being maintained at the fourth initial voltage level Vk4.

Since the level of the second gate-off voltage VOFF2 is less than the level of the first gate-off voltage VOFF1, the level of the second gate-off voltage VOFF2 provided to the gate driver 120 may be controlled such that the level decreasing rate of the second gate-off voltage VOFF2 is greater than the level decreasing rate of the first gate-off voltage VOFF1 in their absolute value.

The level of the gate-off voltage VOFF corresponding to the saturation state of the deterioration of the transistor TR may be set to the second threshold voltage VkT2. In the case that the level of the gate-off voltage reaches the second threshold voltage VkT2 due to the operation of the above-described comparator 152, the gate-off voltage VOFF provided to the gate driver 120 may be controlled to maintain at the second threshold voltage VkT2 even though the operation time increases thereafter. For instance, in the case that the level of the second gate-off voltage VOFF2 gradually decreases to have the same value as the second threshold voltage VkT2, the second gate-off voltage VOFF2 is maintained at the second threshold voltage VkT2.

In the case that the level of the gate-off voltage VOFF decreases in FIG. 2, a difference between the gate-on voltage VON and the gate-off voltage VOFF may also increase. In this case, the magnitude of the gate signal GSi increases, and thus the amount of the current flowing through the transistor TR, which is turned on in response to the gate signal GSi, may increase to compensate the deterioration mentioned above.

Figure 10:
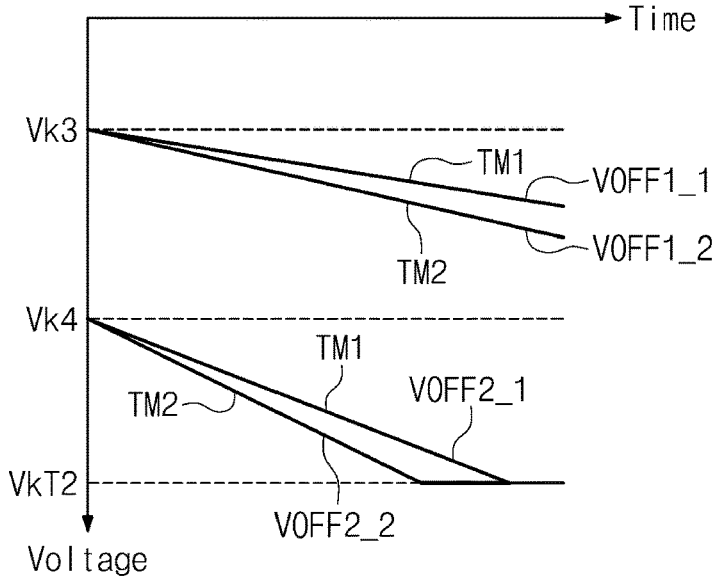
FIG. 10 is a view for explaining an exemplary embodiment of the compensation for the gate-off voltage depending on the operation time and the temperature.

FIG. 10 is a view for explaining an exemplary embodiment of the compensation for the gate-off voltage depending on the operation time and the temperature.

Referring to FIG. 10, the level decreasing rate of the gate-off voltage VOFF may be differently controlled depending on the operation time, the temperature, and the magnitude of the gate-off voltage VOFF at a predetermined time. The level of the gate-off voltage VOFF may be controlled such that the level of the gate-off voltage VOFF provided to the gate driver 120 decreases as the operation time increases and as the temperature increases.

For instance, a level of a first sub-gate-off voltage VOFF1_1 having the third initial voltage level Vk3 (i.e., a voltage level when the operation time is zero) may be controlled such that the level of the first sub-gate-off voltage VOFF1_1 gradually decreases to be less than the third initial voltage level Vk3 as the operation time increases and the temperature increases to the first temperature TM1.

A level of a second sub-gate-off voltage VOFF1_2 having the third initial voltage level Vk3 may be controlled such that the level of the second sub-gate-off voltage VOFF1_2 provided to the gate driver 120 gradually decreases to be less than the third initial voltage level Vk3 and to be less than the level of the first sub-gate-off voltage VOFF1_1 as the operation time increases and the temperature increases to the second temperature TM2 greater than the first temperature TM1.

A level of a third sub-gate-off voltage VOFF2_1 having the fourth initial voltage level Vk4 may be controlled such that the level of the third sub-gate-off voltage VOFF2_1 provided to the gate driver 120 gradually decreases to be less than the fourth initial voltage level Vk4 as the operation time increases and the temperature increases to the first temperature TM1.

A level of a fourth sub-gate-off voltage VOFF2_2 having the fourth initial voltage level Vk4 may be controlled such that the level of the fourth sub-gate-off voltage VOFF2_2 provided to the gate driver 120 gradually decreases to be less than the fourth initial voltage level Vk4 and to be less than the level of the third sub-gate-off voltage VOFF2_1 as the operation time increases and the temperature increases to the second temperature TM2.

The levels of the third and fourth sub-gate-off voltages VOFF2_1 and VOFF2_2 may be controlled such that the level decreasing rates of the third and fourth sub-gate-off voltages VOFF2_1 and VOFF2_2 provided to the gate driver 120 are greater than the level decreasing rates of the first and second sub-gate-off voltages VOFF1_1 and VOFF1_2 in their absolute value.

In the case that the levels of the third and fourth sub-gate-off voltages VOFF2_1 and VOFF2_2 gradually decrease to have the same value as the second threshold voltage VkT2, the third and fourth sub-gate-off voltages VOFF2_1 and VOFF2_2 may be controlled to maintain at the second threshold voltage VkT2 even though the operation time increases thereafter.

In some exemplary embodiments, the levels of the gate-on and -off voltages may be controlled only in consideration of variations of the operation time as described in FIGS. 7 and 9 or controlled in consideration of the operation time and the temperature as described in FIGS. 8 and 10. In the case that only the operation time is considered, the display apparatus 100 may include the timer 160, and the temperature measuring unit 170 may be omitted.

Figure 11:
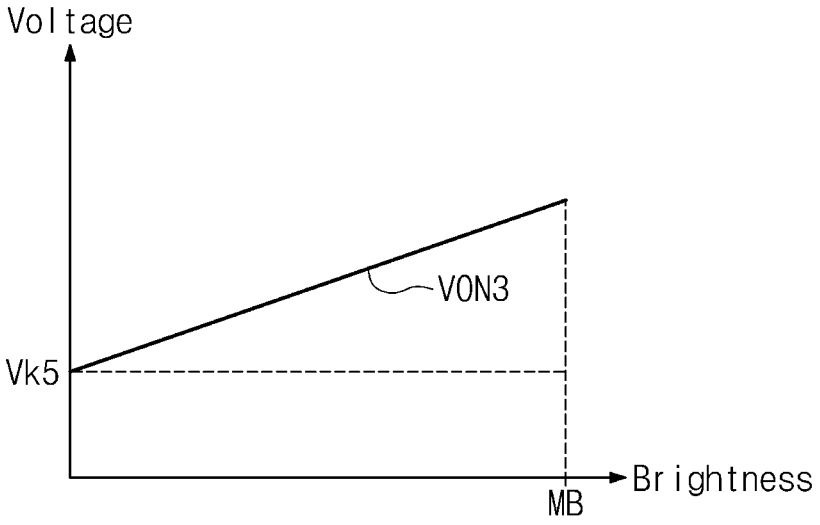
FIG. 11 is a view for explaining an exemplary embodiment of the compensation for the gate-on voltage depending on the brightness.

FIG. 11 is a view for explaining an exemplary embodiment of the compensation for the gate-on voltage according to the brightness.

Referring to FIG. 11, the gate-on voltage VON may have a third gate-on voltage VON3 having a fifth initial voltage level Vk5. The light L generated by the backlight unit 180 is provided to the pixels PX, and thus the light L is provided to the transistor TR of each of the pixels PX.

When the light L is incident to the transistor TR, the transistor TR has a characteristic in which a leakage current increases as an intensity of the light L increases. In the case that the leakage current increases, the amount of the current provided to the pixels PX becomes small, and thus the pixels PX may not be normally charged.

The intensity of the light L corresponds to the brightness value of the light. The brightness value BV calculated by the backlight unit controller 144 is provided to the voltage controller 143, and the voltage controller 143 may control the voltage generator 150 such that the level of the third gate-on voltage VON3 gradually increases as the brightness value BV increases.

A maximum brightness value MB may be predetermined, and when the calculated brightness value BV become the maximum brightness value MB, the level of the third gate-on voltage VON3 is controlled not to increase anymore. That is, the level of the third gate-on voltage VON3 may increase to the maximum brightness value MB.

Figure 12:
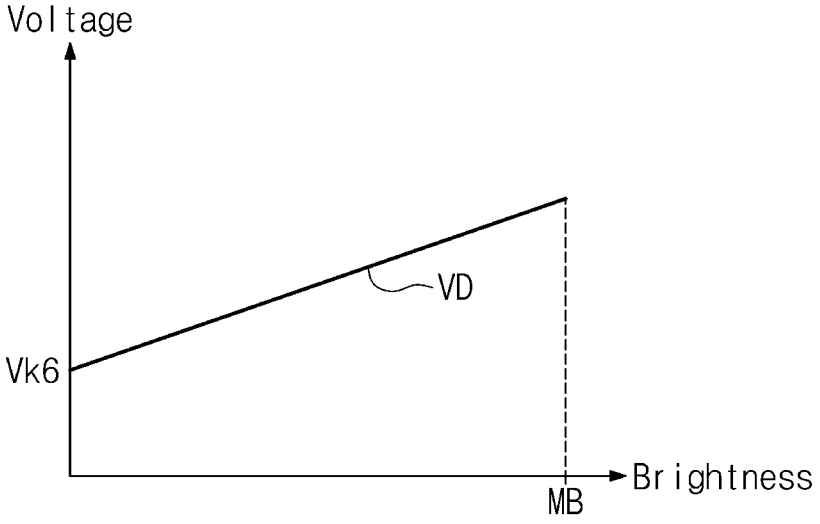
FIG. 12 is a view for explaining an exemplary embodiment of a compensation for a data voltage depending on the brightness.

FIG. 12 is a view for explaining an exemplary embodiment of a compensation for a data voltage according to the brightness.

Referring to FIG. 12, the brightness value BV calculated by the backlight unit controller 144 is provided to the data converter 142, and the more the brightness value BV increases, the greatly the data converter 142 changes the values of the image data DATA to compensate the deterioration mentioned above. Since the magnitudes of the data voltages VD correspond to the values of the image data DATA, the levels of the data voltages VD are controlled to increase as the brightness value BV increases.

In an exemplary embodiment, for an example, in a case that a value of one image data DATA corresponds to a sixth initial voltage level Vk6, the level of the data voltage VD having the sixth initial voltage level Vk6 may be controlled to increase as the brightness BV increases. In the case that the values of the image data DATA correspond to the maximum brightness value MB, the values of the image data DATA are controlled not to change any more. That is, the levels of the data voltages VD are controlled to increase up to the value corresponding to the maximum brightness value MB depending on the brightness value BV.

Figure 13:
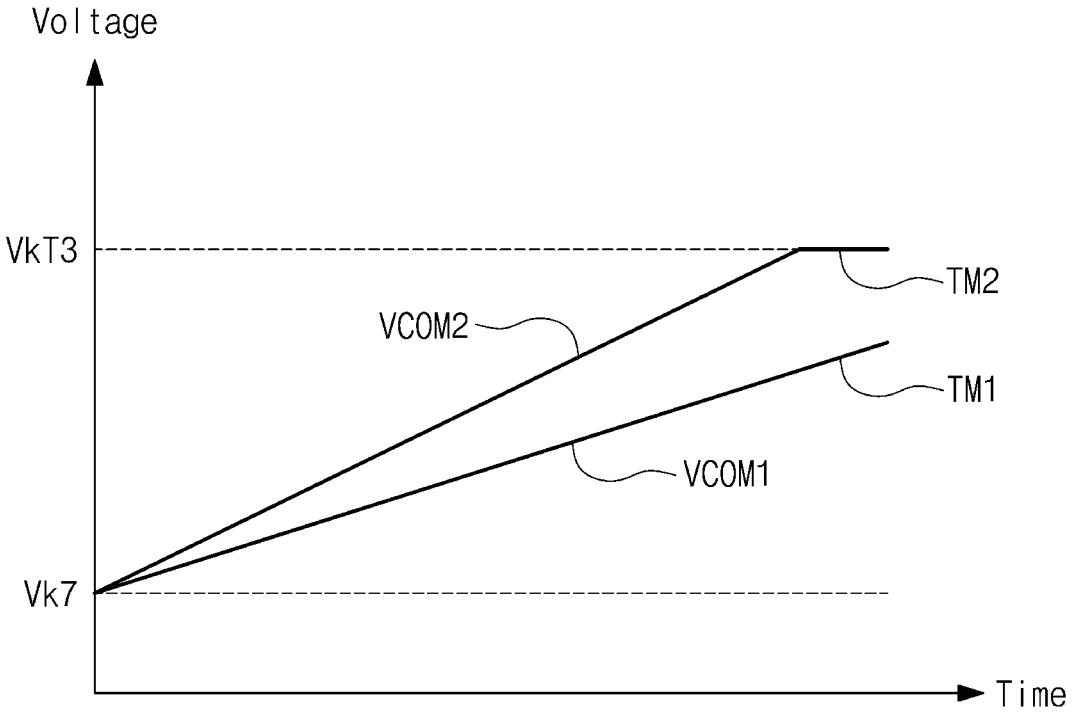
FIG. 13 is a view for explaining an exemplary embodiment of a compensation for a common voltage depending on the operation time and the temperature.

FIG. 13 is a view for explaining an exemplary embodiment of a compensation for a common voltage depending on the operation time and the temperature.

Referring to FIG. 13, the common voltage VCOM may have a seventh initial voltage level Vk7. As the operation time increases and the temperature increases, a level of the common voltage VCOM may vary without being maintained uniformly at the seventh initial voltage level Vk7 due to a polarization phenomenon of the common electrode CE. The polarization phenomenon means that negative electric charges or positive electric charges are accumulated in the common electrode CE due to a difference in level between the voltage applied to the pixel electrode PE and the common voltage VCOM applied to the common electrode CE.

In this case, the level of the common voltage VCOM decreases by the electric charges accumulated in the common electrode CE as the operation time increases and the temperature increases. In a case that the level of the common voltage VCOM decreases without being maintained uniformly, the pixels PX may not be normally charged.

In an exemplary embodiment of the invention, the common voltage VCOM may be compensated in various ways depending on the operation time and the temperature. For instance, the voltage controller 143 may control the voltage generator 150 such that the level of the common voltage VCOM provided to the gate driver 120 increases as the operation time increases and the temperature increases in order to compensate for the decrease of the level of the common voltage VCOM.

In detail, as the temperature increases to the first temperature TM1 and the operation time increases, the level of the common voltage VCOM may be controlled to gradually increase as a first common voltage VCOM1 to compensate the deterioration. As the temperature increases to the second temperature TM2 and the operation time increases, the level of the common voltage VCOM may be controlled to gradually increase as a second common voltage VCOM2 greater than the first common voltage VCOM1. Accordingly, the common voltage VCOM is compensated, and thus the pixels PX may be normally charged.

A polarization amount of the common electrode CE increases depending on the operation time and the temperature and reaches a saturation state. When the polarization amount of the common electrode CE is in the saturation state, the level of the common voltage VCOM corresponding to the polarization amount of the saturation state may be set to the third threshold voltage VkT3. In the case that the level of the common voltage VCOM reaches the third threshold voltage VkT3 due to the operation of the above-described comparator 152, the level of the common voltage VCOM may be controlled to maintain at the third threshold voltage VkT3. In an exemplary embodiment, for an example, when a level of a second common voltage VCOM2 gradually increases and reaches the third threshold voltage VkT3, the level of the second common voltage VCOM2 may be controlled to maintain at the third threshold voltage VkT3 even though the operation time increases thereafter.

Figure 14:
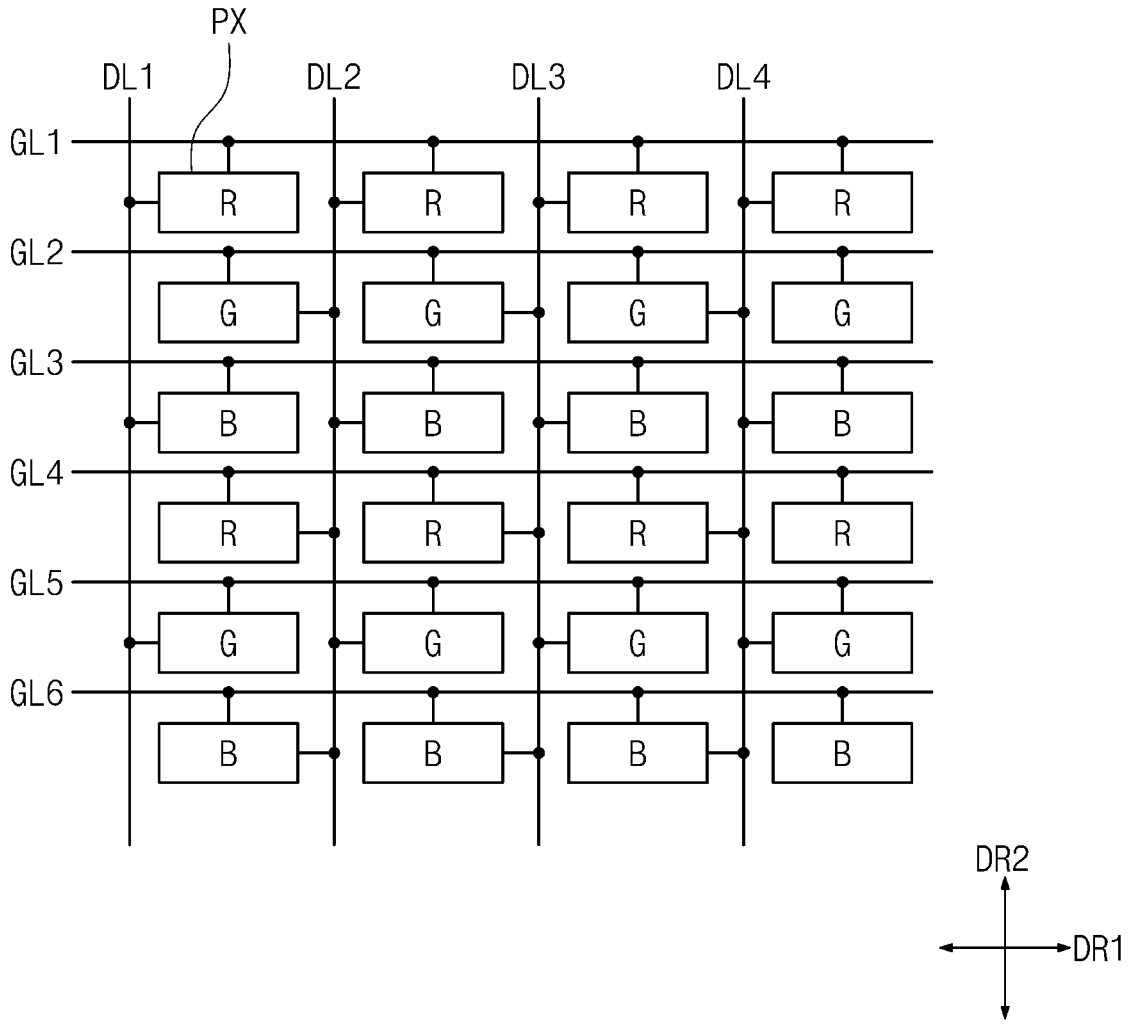
FIG. 14 is a view showing another exemplary embodiment of a configuration of a display panel of a display apparatus according to the invention.

FIG. 14 is a view showing another exemplary embodiment of a configuration of a display panel of a display apparatus according to the invention.

The display apparatus according to the another exemplary embodiment has the same block configuration as that of the display apparatus 100 shown in FIG. 1 except for an operation according to the arrangement of the pixels PX. Accordingly, hereinafter, different features of the display apparatus according to the another exemplary embodiment from those of the display apparatus 100 shown in FIG. 1 will be mainly described.

Referring to FIG. 14, the pixels PX include a plurality of red pixels R arranged in the first direction DR1, a plurality of green pixels G arranged in the first direction DR1, and a plurality of blue pixels B arranged in the first direction DR1. The red pixels R, the green pixels G, and the blue pixels B are arranged along the second direction DR2 in order of red, green, and blue pixels R, G, and B. The pixels PX are arranged in plural rows and plural columns, the row is defined by the pixels PX arranged in the same line of the first direction DR1, and the column is defined by the pixels PX arranged in the same line of the second direction DR2.

The pixels PX arranged in a h-th row are connected to a h-th gate line. Accordingly, the pixels PX having the same color and arranged in the h-th row may be connected to the same h-th gate line. The pixels PX arranged in a k-th column are arranged between a k-th data line and a k+1-th data line and alternately connected to the k-th data line and the k+1-th data line in the second direction DR2.

FIG. 14 shows the pixels PX connected to first to sixth gate lines GL1 to GL6 and first to fourth data lines DL1 to DL4 as a representative example, but the number of the pixels PX in the display panel according to the invention should not be limited thereto or thereby.

Figure 15:
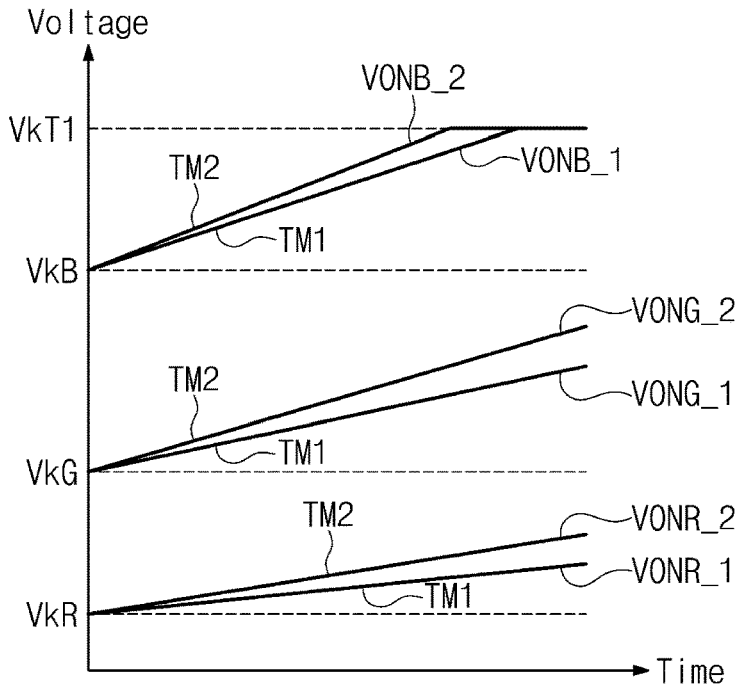
FIG. 15 is a view explaining a compensation for the gate-on voltage depending on a type of the pixels shown in FIG. 14.
Figure 16:
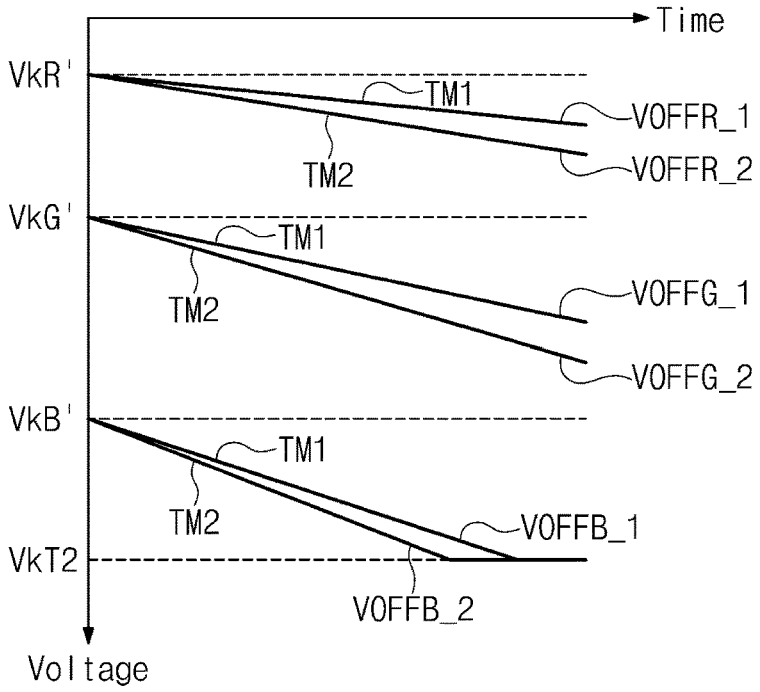
FIG. 16 is a view explaining a compensation for the gate-off voltage depending on a type of the pixels shown in FIG. 14.

FIG. 15 is a view for explaining an exemplary embodiment of a compensation for the gate-on voltage according to a type of the pixels shown in FIG. 14, and FIG. 16 is a view for explaining an exemplary embodiment of a compensation for the gate-off voltage according to a type of the pixels shown in FIG. 14.

Referring to FIGS. 15 and 16, the deterioration of the transistors TR may be different depending on the kind of the pixels PX. In an exemplary embodiment, for an example, the deterioration of the transistor TR is proportional to an energy of the light the transistor TR controls, a blue light has an energy greater than that of a green light, and the green light has an energy greater than that of a red light. Accordingly, a deterioration amount of the transistor TR of the blue pixels B may be greater than a deterioration amount of the transistor TR of the green pixels G, and the deterioration amount of the transistor TR of the green pixels G may be greater than a deterioration amount of the transistor R of the red pixels R.

The gate lines GL1 to GL6 may include first gate lines connected to the red pixels R, second gate lines connected to the green pixels G, and third gate lines connected to the blue pixels B. First gate signals applied to the first gate lines, second gate signals applied to the second gate lines, and third gate signals applied to the third gate lines may be generated separately from each other.

Hereinafter, the gate-on and -off voltages VON and VOFF used to generate the first gate signals will be referred to as red gate-on and -off voltages VONR_1, VONR_2, VOFFR_1, and VOFFR_2 respectively, the gate-on and -off voltages VON and VOFF used to generate the second gate signals will be referred to as green gate-on and -off voltages VONG_1, VONG_2, VOFFG_1, and VOFFG_2 respectively, and the gate-on and -off voltages VON and VOFF used to generate the third gate signals will be referred to as blue gate-on and -off voltages VONB_1, VONB_2, VOFFB_1, and VOFFB_2 respectively. Here, two signals (e.g., VONR_1 and VONR_2) for the same color and the same gate on or off voltage are described since temperatures are different from each other.

Since the deterioration amounts of the transistors TR are different from each other according to the kind of the pixels PX, the voltage controller 143 may control the voltage generator 150 such that the gate-on voltage and the gate-off voltage are differently compensated according to the kind of the pixels PX. The blue gate-on and -off voltages VONB_1, VONB_2, VOFFB_1, and VOFFB_2 provided to the gate driver 120 may be controlled to be greater than the green gate-on and -off voltages VONG_1, VONG_2, VOFFG_1, and VOFFG_2 provided to the gate driver 120, and the green gate-on and -off voltages VONG_1, VONG_2, VOFFG_1, and VOFFG_2 may be controlled to be greater than the red gate-on and -off voltages VONR_1, VONR_2, VOFFR_1, and VOFFR_2 provided to the gate driver 120.

In an exemplary embodiment, for an example, an initial voltage level VkB of the blue gate-on voltages VONB_1 and VONB_2 provided by the voltage generator 150 is set greater than an initial voltage level VkG of the green gate-on voltages VONG_1 and VONG_2 provided by the voltage generator 150, and the initial voltage level VkG of the green gate-on voltages VONG_1 and VONG_2 is set greater than an initial voltage level VkR of the red gate-on voltages VONR_1 and VONR_2 provided by the voltage generator 150.

The levels of the blue gate-on voltages VONB_1 and VONB_2, the levels of the green gate-on voltages VONG_1 and VONG_2, and the levels of the red gate-on voltages VONR_1 and VONR_2 are controlled to gradually increase as the operation time increases and increase significantly more at the second temperature TM2, which is greater than the first temperature TM1, than at the first temperature TM1.

Level increasing rates of the blue gate-on voltages VONB_1 and VONB_2 are controlled to be greater than level increasing rates of the green gate-on voltages VONG_1 and VONG_2, and the level increasing rates of the green gate-on voltages VONG_1 and VONG_2 are controlled to be greater than level increasing rates of the red gate-on voltages VONR_1 and VONR_2. In a case that the blue gate-on voltages VONB_1 and VONB_2 reach the first threshold voltage VkT1, the blue gate-on voltages VONB_1 and VONB_2 are controlled to maintain at the first threshold voltage VkT1.

An initial voltage level VkB' of the blue gate-off voltages VOFFB_1 and VOFFB_2 is set less than an initial voltage level VkG' of the green gate-off voltages VOFFG_1 and VOFFG_2, and the initial voltage level VkG' of the green gate-off voltages VOFFG_1 and VOFFG_2 is set less than an initial voltage level VkR' of the red gate-off voltages VOFFR_1 and VOFFR_2.

The levels of the blue gate-off voltages VOFFB_1 and VOFFB_2, the levels of the green gate-off voltages VOFFG_1 and VOFFG_2, and the levels of the red gate-off voltages VOFFR_1 and VOFFR_2 are controlled to gradually decrease as the operation time increases and decrease significantly more at the second temperature TM2, which is greater than the first temperature TM1, than at the first temperature TM1, level decreasing rates of the blue gate-off voltages VOFFB_1 and VOFFB_2 are greater than level decreasing rates of the green gate-off voltages VOFFG_1 and VOFFG_2, and the level decreasing rates of the green gate-off voltages VOFFG_1 and VOFFG_2 are greater than level decreasing rates of the red gate-off voltages VOFFR_1 and VOFFR_2 in their absolute values. In a case that the blue gate-off voltages VOFFB_1 and VOFFB_2 reach the second threshold voltage VkT2, the blue gate-off voltages VOFFB_1 and VOFFB_2 are controlled to maintain at the second threshold voltage VkT2.

Accordingly, the gate-on voltage VON and the gate-off voltage VOFF are compensated differently depending on the colors of the pixels PX, and thus the pixels PX may be normally charged.

Figure 17:
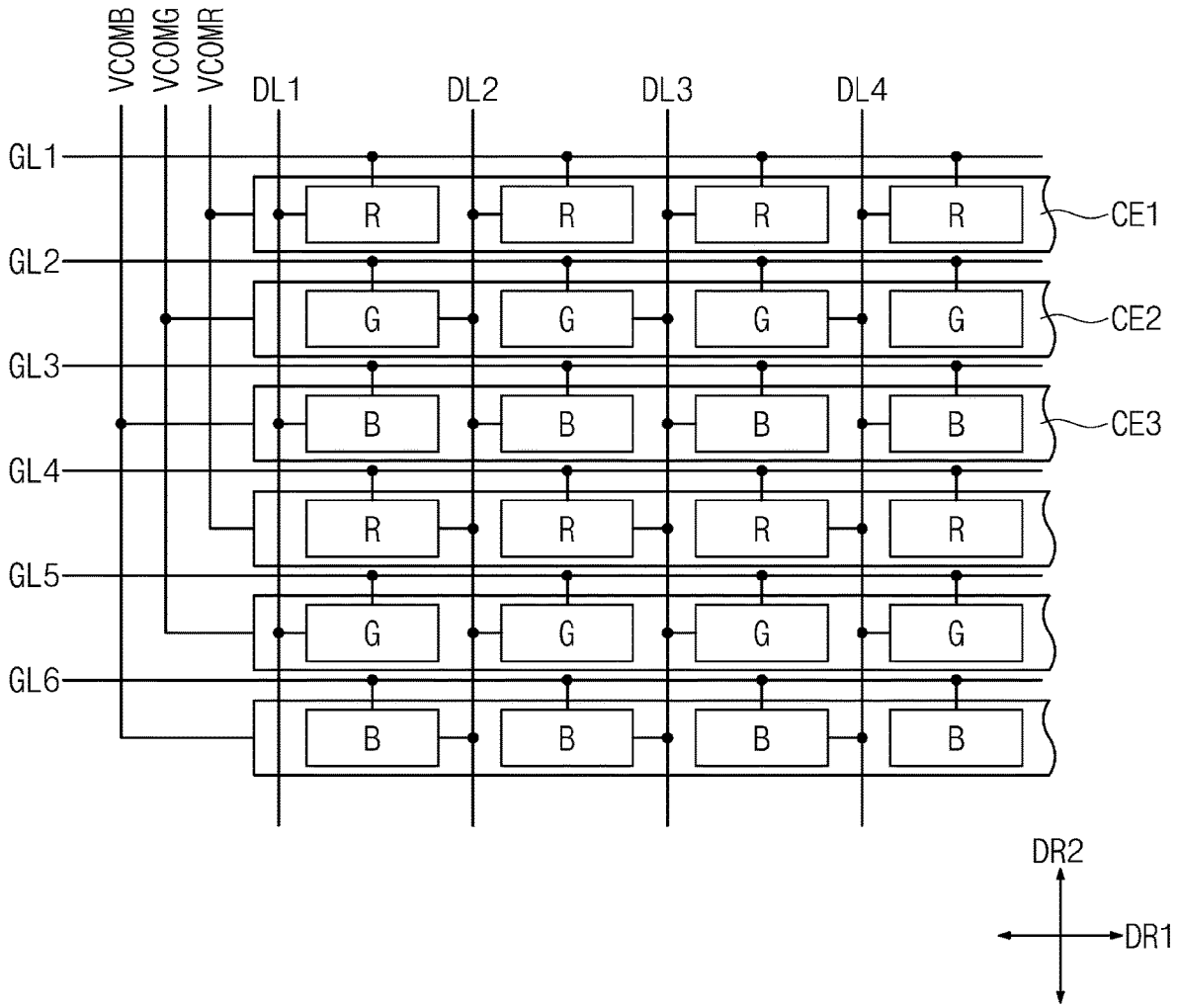
FIG. 17 is a view showing still another exemplary embodiment of a configuration of a display panel of a display apparatus according to the invention.

FIG. 17 is a view showing still another exemplary embodiment of a configuration of a display panel of a display apparatus according to the invention.

The display apparatus according to the still another exemplary embodiment has the same block configuration as that of the display apparatus 100 shown in FIG. 1 except for an operation according to configurations of common electrodes CE1, CE2, and CE3. Accordingly, hereinafter, different features of the display apparatus according to the still another exemplary embodiment from those of the display apparatus 100 shown in FIG. 1 will be mainly described.

Referring to FIG. 17, since the type of the pixels PX and a structure in which the pixels PX are connected to gate lines GL1 to GL6 and data lines DL1 to DL4 are the same as those of FIG. 14, detailed descriptions thereof will be omitted.

The common electrodes CE1, CE2, and CE3 include a plurality of first common electrodes CE1, a plurality of second common electrodes CE2, and a plurality of third common electrodes CE3. The first, second, and third common electrodes CE1, CE2, and CE3 extend in the first direction DR1 and are arranged in the second direction DR2. Each of the first, second, and third common electrodes CE1, CE2, and CE3 is arranged to overlap with the pixels PX arranged in a corresponding row among the pixels PX arranged in plural rows.

The first common electrodes CE1 are arranged to overlap with red pixels R, the second common electrodes CE2 are arranged to overlap with green pixels G, and the third common electrodes CE3 are arranged to overlap with blue pixels B. The first common electrodes CE1 are connected to each other to commonly receive a red common voltage VCOMR. The second common electrodes CE2 are connected to each other to commonly receive a green common voltage VCOMG. The third common electrodes CE3 are connected to each other to commonly receive a blue common voltage VCOMB.

Figure 18:
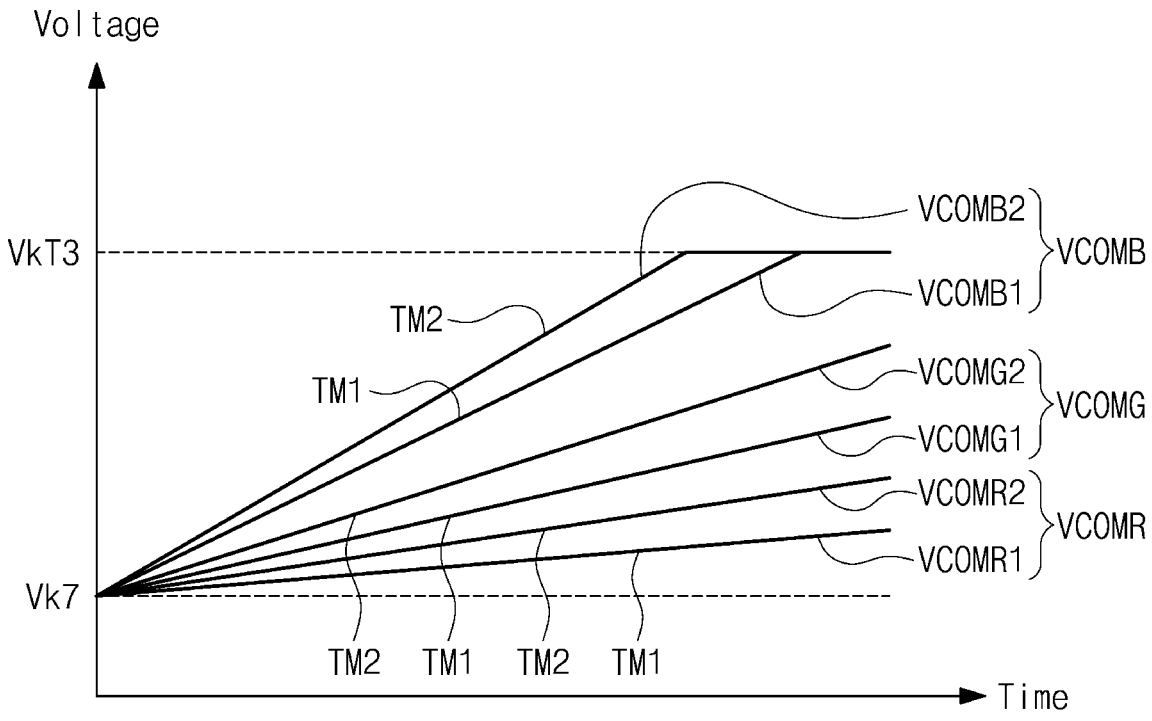
FIG. 18 is a view for explaining an exemplary embodiment of a compensation for a common voltage depending on a type of the pixels shown in FIG. 17.

FIG. 18 is a view for explaining an exemplary embodiment of a compensation for a common voltage according to a type of the pixels shown in FIG. 17.

Decreasing rates of the common voltages VCOMR, VCOMG, and VCOMB due to a polarization phenomenon may vary depending on the type of the pixels PX. As an example, due to the polarization phenomenon, the decreasing rate of the blue common voltage VCOMB applied to the blue pixels B is greater than the decreasing rate of the green common voltage VCOMG applied to the green pixels G, and the decreasing rate of the green common voltage VCOMG applied to the green pixels G is greater than the decreasing rate of the red common voltage VCOMR applied to the red pixels R.

The blue common voltage VCOMB, the green common voltage VCOMG, and the red common voltage VCOMR may have the seventh initial voltage level Vk7. The voltage controller 143 may control the voltage generator 150 such that the blue common voltage VCOMB, the green common voltage VCOMG, and the red common voltage VCOMR are differently compensated depending on the operation time and the temperature.

Referring to FIG. 18, levels of the blue common voltage VCOMB, the green common voltage VCOMG, and the red common voltage VCOMR provided to the gate driver 120 may be controlled to increase as the operation time increases and the temperature increases. In addition, a level increasing rate of the blue common voltage VCOMB may be controlled to be greater than a level increasing rate of the green common voltage VCOMG, and the level increasing rate of the green common voltage VCOMG may be controlled to be greater than a level increasing rate of the red common voltage VCOMR.

For instance, as the operation time increases, the level of the blue common voltage VCOMB is controlled to increase greater than the level of the green common voltage VCOMG, and the level of the green common voltage VCOMG is controlled to increase greater than the level of the red common voltage VCOMR. In addition, in the case that the temperature increases to the first temperature TM1, the level of the red common voltage VCOMR is controlled to be a level of a first sub-red common voltage VCOMR1, and in the case that the temperature increases to the second temperature TM2, the level of the red common voltage VCOMR is controlled to be a level of a second sub-red common voltage VCOMR2 greater than the level of the first sub-red common voltage VCOMR1.

In the case that the temperature increases to the first temperature TM1, the level of the green common voltage VCOMG is controlled to be a level of a first sub-green common voltage VCOMG1, and in the case that the temperature increases to the second temperature TM2, the level of the green common voltage VCOMG is controlled to be a level of a second sub-green common voltage VCOMG2 greater than the level of the first sub-green common voltage VCOMG1.

In the case that the temperature increases to the first temperature TM1, the level of the blue common voltage VCOMB is controlled to be a level of a first sub-blue common voltage VCOMB1, and in the case that the temperature increases to the second temperature TM2, the level of the blue common voltage VCOMB is controlled to be a level of a second sub-blue common voltage VCOMB2 greater than the level of the first sub-blue common voltage VCOMB1.

As described above, since the common voltages VCOMR, VCOMG, and VCOMB are differently compensated depending to the type of the pixels PX, the pixels PX may be normally charged.

Although the exemplary embodiments of the invention have been described, it is understood that the invention should not be limited to the exemplary embodiments described above, but various changes and modifications can be made by one ordinary skilled in the art within the spirit and scope of the invention as hereinafter claimed. Therefore, the disclosed subject matter should not be limited to any single exemplary embodiment described herein, and the scope of the inventive concept shall be determined according to the attached claims.

What is claimed is:

1. A display apparatus comprising:

a display panel which comprises a plurality of pixels;

a gate driver which generates a plurality of gate signals using a gate-on voltage and a gate-off voltage having a level less than the gate-on voltage and provides the gate signals to the pixels;

a data driver which generates a plurality of data voltages corresponding to image data and provides the data voltages to the pixels;

a timing controller which controls an operation timing of the gate driver and the data driver;

a voltage generator which generates the gate-on voltage and the gate-off voltage and provides the gate-on voltage and the gate-off voltage to the gate driver; and a timer which measures an operation time and provides the measured operation time to the timing controller, wherein the timing controller controls the voltage generator such that a level of the gate-on voltage is controlled depending on the operation time, and the level of the gate-on voltage is controlled differently depending on a magnitude of the gate-on voltage such that the level of the gate-on voltage increases as the operation time increases and a level increasing rate of the gate-on voltage becomes greater as an initial voltage level of the gate-on voltage increases.

2. The display apparatus of claim 1, wherein the timing controller:

receives image signals, converts the image signals to the image data, and provides the image data to the data driver and comprises a voltage controller which controls the voltage generator.

3. The display apparatus of claim 2, further comprising a temperature measuring unit which measures an ambient temperature of the display panel and provides the ambient temperature to the timing controller, wherein the voltage controller controls the voltage generator such that the level of the gate-on voltage is controlled depending on the temperature.

4. The display apparatus of claim 3, wherein the level of the gate-on voltage is controlled to increase as the temperature increases.

5. The display apparatus of claim 3, wherein the voltage generator compares the gate-on voltage to a first threshold voltage and maintains the gate-on voltage at the first threshold voltage when the level of the gate-on voltage is equal to the first threshold voltage.

6. The display apparatus of claim 3, wherein the voltage controller controls the voltage generator such that a level of the gate-off voltage is controlled depending on the operation time and the temperature, and the level of the gate-off voltage is controlled differently depending on a magnitude of the gate-off voltage.

7. The display apparatus of claim 6, wherein the level of the gate-off voltage is controlled to decrease as the operation time increases and the temperature increases.

8. The display apparatus of claim 6, wherein an absolute value of a level decreasing rate of the gate-off voltage is controlled to increase as an initial voltage level of the gate-off voltage decreases.

9. The display apparatus of claim 6, wherein the voltage generator compares the gate-off voltage to a second threshold voltage and maintains the gate-off voltage at the second threshold voltage when the level of the gate-off voltage is equal to the second threshold voltage.

10. The display apparatus of claim 3, wherein each of the pixels comprises:

a pixel electrode which receives a corresponding data voltage among the data voltages;

a common electrode which faces the pixel electrode and receives a common voltage; and a liquid crystal layer disposed between the pixel electrode and the common electrode, wherein the voltage controller controls the voltage generator such that a level of the common voltage is controlled depending on the operation time and the temperature.

11. The display apparatus of claim 10, wherein the level of the common voltage is controlled to increase as the operation time increases and the temperature increases.

12. The display apparatus of claim 10, wherein the voltage generator compares the common voltage to a third threshold voltage and maintains the common voltage at the third threshold voltage when the level of the common voltage is equal to the third threshold voltage.

13. The display apparatus of claim 2, further comprising a backlight unit which provides a light to the display panel, wherein the timing controller further comprises a backlight unit controller which receives the image signals, analyzes the image signals to calculate a brightness value, controls a brightness of the backlight unit depending on the brightness value, and provides the calculated brightness value to the voltage controller.

14. The display apparatus of claim 13, wherein the timing controller controls values of the image data such that levels of the data voltages increase as the brightness value increases.

15. The display apparatus of claim 13, wherein the voltage controller controls the voltage generator such that the level of the gate-on voltage increases as the brightness value increases.

16. A display apparatus comprising:

a display panel which comprises a plurality of pixels connected to a plurality of gate lines and a plurality of data lines;

a gate driver which generates a plurality of gate signals using a gate-on voltage and a gate-off voltage having a level less than the gate-on voltage and provides the gate signals to the pixels through the gate lines;

a data driver which provides a plurality of data voltages to the pixels through the data lines;

a timing controller which controls an operation timing of the gate driver and the data driver;

a voltage generator which generates the gate-on voltage and the gate-off voltage and provides the gate-on voltage and the gate-off voltage to the gate driver;

a timer which measures an operation time and provides the measured operation time to the timing controller; and a temperature measuring unit which measures an ambient temperature of the display panel and provides the measured ambient temperature to the timing controller, wherein the timing controller controls the voltage generator such that a level of the gate-on voltage is controlled depending on the operation time and the temperature, and the level of the gate-on voltage is controlled depending on colors of the pixels different from the level of the gate-on voltage being controlled depending on the operation time and the temperature.

17. The display apparatus of claim 16, wherein the pixels comprise a plurality of red pixels, a plurality of green pixels, and a plurality of blue pixels, the gate lines comprise a plurality of first gate lines connected to the red pixels, a plurality of second gate lines connected to the green pixels, and a plurality of third gate lines connected to the blue pixels, and a level of a red gate-on voltage used to generate first gate signals applied to the first gate lines, a level of a green gate-on voltage used to generate second gate signals applied to the second gate lines, and a level of a blue gate-on voltage used to generate third gate signals applied to the third gate lines are differently controlled depending on the operation time and the temperature.

18. The display apparatus of claim 17, wherein the levels of the red, green, and blue gate-on voltages are controlled to increase as the operation time increases and the temperature increases, an initial level of the blue gate-on voltage is greater than an initial level of the green gate-on voltage, the initial level of the green gate-on voltage is greater than an initial level of the red gate-on voltage, a level increasing rate of the blue gate-on voltage is controlled to be greater than a level increasing rate of the green gate-on voltage as the operation time increases and the temperature increases, and the level increasing rate of the green gate-on voltage is controlled to be greater than a level increasing rate of the red gate-on voltage as the operation time increases and the temperature increases.

19. The display apparatus of claim 17, wherein a level of a red gate-off voltage used to generate the first gate signals, a level of a green gate-off voltage used to generate the second gate signals, and a level of a blue gate-off voltage used to generate the third gate signals are differently controlled depending on the operation time and the temperature, an initial level of the blue gate-off voltage is set less than an initial level of the green gate-off voltage, the initial level of the green gate-off voltage is set less than an initial level of the red gate-off voltage, a level decreasing rate of the blue gate-off voltage is controlled to be greater than a level decreasing rate of the green gate-off voltage in their absolute value as the operation time increases and the temperature increases, and the level decreasing rate of the green gate-off voltage is controlled to be greater than a level decreasing rate of a red gate-off voltage in their absolute value as the operation time increases and the temperature increases.

20. The display apparatus of claim 17, wherein each of the pixels comprises:

a pixel electrode which receives a corresponding data voltage among the data voltages;

a common electrode which faces the pixel electrode; and a liquid crystal layer disposed between the pixel electrode and the common electrode, the common electrode comprising:

a plurality of first common electrodes overlapped with the red pixels;

a plurality of second common electrodes overlapped with the green pixels; and a plurality of third common electrodes overlapped with the blue pixels, wherein levels of red, green, and blue common voltages applied to the first, second, and third common electrodes, respectively, are controlled to increase as the operation time increases and the temperature increases, a level increasing rate of the blue common voltage is controlled to be greater than a level increasing rate of the green common voltage, and the level increasing rate of the green common voltage is controlled to be greater than a level increasing rate of the red common voltage.

* * * * *